United States Patent [19]

Maeda

[11] Patent Number: 4,826,570

[45] Date of Patent: May 2, 1989

[54] SIZING AGENT

[75] Inventor: Akio Maeda, Hikari City, Japan

[73] Assignee: Kabushiki Kaisha Chiyoda Kagaku Kenkyusho, Yamagu Prefecture, Japan

[21] Appl. No.: 152,131

[22] Filed: Feb. 4, 1988

Related U.S. Application Data

[63] Continuation of Ser. No. 859,142, May 2, 1986, abandoned.

[51] Int. Cl.[4] ..... D21D 3/00

[52] U.S. Cl. ..... 162/158; 162/181.2

[58] Field of Search ..... 162/158

[56] References Cited

U.S. PATENT DOCUMENTS

| | | | |
|---|---|---|---|
| 4,514,229 | 4/1985 | Sato et al. | 106/13 T |
| 4,544,414 | 9/1985 | Kawatani | 106/287.2 X |
| 4,611,087 | 9/1986 | Yamashita et al. | 252/142 |

*Primary Examiner*—Theodore Morris

*Attorney, Agent, or Firm*—Tilton, Fallon, Lungmus & Chestnut

[57] ABSTRACT

A sizing agent is provided which has at least a self-emulsifiable property, which is stable for long period of time as well being effective in low concentrations.

6 Claims, No Drawings

SIZING AGENT

This application is a continuation of application Ser. No. 859,142, filed May 2, 1986 now abandoned.

BACKGROUND OF THE INVENTION

The present invention relates to a sizing agent for use in cellulosic paper-making.

Heretofore a wide variety of sizing agents for use in paper-making have been proposed such as rosin-based, wax-based, alkylketene dimer based, polymer based, alkenylsuccinic anhydride based ones and the like and they have all been actually employed commercially. Since many of these conventional sizing agents are inherently water-insoluble, it is impossible to use them along as such so it is usually necessary to disperse and/or emulsify them in water with the aid of an emulsifying agent. However, the emulsifying operation has such drawbacks that it is only achieved with difficulty and that said operation requires additional costs therefor.

The alkenylsuccinic anhydride based sizing agents in particular undergo hydrolysis with time due to their inherent nature if they are kept in contact with water for a short period of time, thereby losing their sizing effect.

Due to the poor stability in water of said alkenylsuccinic anhydrides based sizing agents, they have the serious limitation that the sizing treatment should be finished in a short period of time and this has been the greatest drawback for applying them commercially, in spite of such excellent effects that they exert adequate sizing effect in lower concentrations, thus providing greater economical benefits as compared to that of rosin based, alkenylketene dimer based, wax based sizing agents and the like.

The inventor has carried out a wide variety of investigations on the sizing effect of alkenylsuccinic acids and their derivatives having various structures, and as a result he has found that unsaturated hydrocarbyl partial esters of alkenylsuccinic acids and the salts thereof are at least self-emulsifiable with water and provide an excellent sizing effect.

For example, unsaturated hydrocarbyl diesters of alkenylsuccinic acids not only entail significant difficulties in their synthesis but they also require troublesome procedures for emulsifying similar to conventional sizing agents and further they require additional auxiliaries such as an activator. In addition, they are inferior to unsaturated monohydrocarbyl esters in sizing effect, which makes them useless commercially.

Further, saturated partial(mono)- and di- hydrocarbyl esters of alkenylsuccinic acids have substantially no sizing effect, thus they cannot be used as a sizing agent. This is due to the fact that saturated hydrocarbyl mono- and di-esters of alkenylsuccinic acids are not substantially absorbed by paper and also they can only impart poor repellancy to paper. Contrary to the saturated hydrocarbyl mono- or di-esters, alkenylsuccinic anhydrides per se are readily absorbed by paper and make the resultant paper water repellent thereby exhibiting a sizing effect. However, once the anhydrides have been hydrolyzed to the corresponding dicarboxylic acids, the resulting dicarboxylic acids are not readily absorbed, thus losing their sizing effect. In this way, alkenylsuccinic anhydrides have drawbacks in that they drastically change their identity in water with time, thereby requiring a adequate care.

He has also found that if unsaturated hydrocarbyl partial esters of alkenylsuccinic acids or the water-soluble salt thereof are employed in combination with an acid catalyst, a further improved sizing effect can be obtained.

SUMMARY OF THE INVENTION

The object of the present invention is to provide a sizing agent which is at least self-emulsifiable and stable in water for a long period of time and which is effective in lower concentration.

Another object of the present invention is to provide a sizing agent which can be prepared without any difficulties.

Further objects of the present invention will become apparent from the descriptions hereinafter referred to.

Thus, the present invention relates to a sizing agent for use in paper-making comprising at least one unsaturated hydrocarbyl partial ester of alkenylsuccinic acid of the general formula:

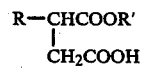

wherein R represents an unsaturated hydrocarbyl group having at least six carbon atoms and R′ represents an unsaturated hydrocarbyl group having 3 to 18 carbon atoms, and a water-soluble salt thereof as an active component.

The present invention further relates to a sizing agent comprising at least one unsaturated hydrocarbyl partial ester of alkenylsuccinic acid set forth above and/or at least one water-soluble salt thereof together with at least one acid catalyst.

DETAILED DESCRIPTION OF THE INVENTION

It was generally known that compounds having an unsaturated group or groups are strongly absorbed by paper and render the paper more hydrophobic than saturated compounds. The sizing agent of the present invention supports the above fact. Therefore, in contrast to saturated esters of alkenylsuccinic acids which are only poorly absorbent by paper, thus having no sizing effect, unsaturated hydrocarbyl partial esters of alkenylsuccinic acids have surprisingly been found to be strongly absorbed by paper, making the paper significantly water-repellant, thereby providing an excellent sizing effect along with the advantages that they are not hydrolyzed by water, so that they can maintain their identity as a stable solution or dispersion in water for a long period of time. The unsaturated hydrocarbyl partial esters of alkenylsuccinic acids not only exhibit strong absorbability towards paper, but they also show no discoloring, and indicate a sustained stable sizing effect over a long period of time. Moreover, the unsaturated hydrocarbyl partial esters of the present invention provides consistently stable sized paper sheets even if said paper is treated with the agent in a low concentration.

The alkenylsuccinic anhydride or corresponding acid employed comprises all the alkenylsuccinic acid or anhydride in which the substituting side chain contains six or more than six carbon atoms and these include, for example, hexenyl-, octenyl-, decenyl-, octadecenyl-, dococenyl-, triancotenyl-, eicocenyl-succinic acid and the like and corresponding anhydrides. As the unsaturated alcohols, there may be mentioned all the unsaturated alcohols having 3 to 18 carbon atoms such as allyl-, propargyl-, butenyl-, butyn-, pentenyl-, hexenyl-, octenyl-, decenyl-, laurenyl-, oleyl-alcohols and the like.

The unsaturated partial esters of the present invention can be converted to water-soluble products or at least self-emulsifiable products by converting the remaining free carboxyl groups into a salt with alkaline metals or water-soluble amine whereby a stable aqueous solution or dispersion can be obtained by adding it to water. Upon use, it is preferably to use it with a cationic starch, as alkyleneoxide adduct based activator and the like as is conventionally employed in the art to fully assure the benefit of the sizing agent, although such use of an activator is not essential.

The unsaturated hydrocarbyl partial estersof alkenylsuccinic acids can be easily synthesized by a conventional esterification technique. Thus, an alkenylsuccinic anhydride or the corresponding acids and unsaturated alcohol are heated together to cause a reaction between them in the presence or absence of a catalyst through a ring opening in the case of anhydride, while in the case of acid through a dehydration to form an unsaturated partial ester. The ration between the acidic starting material to the unsaturated alcohol is such that the amount of the alcohol is sufficient to esterify only one of the carboxyl groups of the acid.

The unsaturated hydrocarbyl partial esters of alkenylsuccinic acids of the present invention may be added to paper material in an amount of 0.0001 to 10 parts by weight per 100 parts by weight of paper material (dry base) and preferably 0.01 to 2.0 parts by weight per 100 parts by weight of paper material.

The use of the above catalyst can significantly reduce the amount of unsaturated hydrocarbyl partial ester and thus provide great economical advantages.

Although this increase in the sizing effect achievable by the use of acid catalyst cannot be fully understood at present, the following assumption may be induced, although this should not be regarded as binding to any particular theory. An acid catalyst such as sulfonic acid, organic phosphoric acid, inorganic acid or Lewis acid excites the unsaturated linkage in the unsaturated hydrocarbyl partial esters, thereby bringing about a state where the double or triple unsaturated bond can be readily broken, so as to promote the etherification reaction with hydroxyl groups contained in cellulose or the esterification reaction by dehydration and that as a result the fixing of the sizing agent to paper is more fully effected in a short period of time.

As the acid catalyst, there may be mentioned sulfonic acid, organic phosphoric acid, inorganic acid, such as phosphoric acid, phosphorous acid, hypophosphorous acid, sulfuric acid, nitric acid, hydrochloric acid or the like, a Lewis acid such as boron fluoride, zinc chloride, aluminum chloride, ferric chloride and the like. These acid catalysts can be used alone or two or more in combination.

Among the sulfonic acid catalysts are included benzenesulfonic acid, toluene sulfonic acid, dimethylbenzene sulfonic acid, ethylbenzene sulfonic acid, diethylbenzene sulfonic acid, triethylbenzene sulfonic acid, styrene sulfonic acid, dichlorobenzene sulfonic acid, dichlorotoluene sulfonic acid, aniline sulfonic acid, aminotoluene sulfonic acid, dimethylaniline sulfonic acid, diaminobenzene sulfonic acid, diaminotoluene sulfonic acid, aniline disulfonic acid, anilinetrisulfonic acid, diaminobenzene disulfonic acid, ethyltoluidine sulfonic acid, diethylaniline sulfonic acid, chloroaniline sulfonic acid, aminochlorotoluene sulfonic acid, dichloroaniline sulfonic acid, nitrobenzenesulfonic acid, nitrotoluene sulfonic acid, dinitrobenzene sulfonic acid, dinitrostyrene sulfonic acid, nitrochlorobenzene sulfonic acid, chloronitrotoluene sulfonic acid, dinitrochlorobenzene sulfonic acid, nitroaniline sulfonic acid, phenylhydrazine sulfonic acid, methylphenylhydrazine sulfonic acid, phenol sulfonic acid, cresolsulfonic acid, dihydroxybenzene sulfonic acid, methacryloxybenzene sulfonic acid, aminophenol sulfonic acid, aminomethoxybenzene sulfonic acid, dimethoxyaniline sulfonic acid, chloroaminohydroxybenzene sulfonic acid, nitroaminohydroxybenzene sulfonic acid, butylbenzene sulfonic acid, naphthalene sulfonic acid, naphthalene disulfonic acid, methylnaphthyl sulfonic acid, ethylnaphthyl sulfonic aid, propylnaphthyl sulfonic acid, butylnaphthyl sulfonic acid, lignin sulfonic acid, naphthalene disulfonic acid, naphthalene trisulfonic acid, naphthylamine sulfonic acid, naphthylaminedisulfonic acid, naphthylamine trisulfonic acid, nitronaphthalene sulfonic acid, nitronaphthalene disulfonic acid, nitronaphthalene trisulfonic acid, naphthol sulfonic acid, dihydroxynaphthalene sulfonic acid, naphtholdisulfonic acid, aminonaphtholsulfonic acid, aminonaphtholdisulfonic acid, 1-(4'-amino-2'-chlorobenzoylamino)-8-naphthtol-3,6-disulfonic acid, 1-(4'-nitrobenzene)amino-8-naphthol-3,6-disulfonic and nitronaphthol sulfonic acid, anthracene sulfonic acid, anthraquinone sulfonic acid, anthraquinone, disulfonic acid, aminoanthraquinone sulfonic acid, diaminoanthraquinone disulfonic acid, nitroanthraquinone sulfonic acid, dihydroanthraquinone sulfonic acid, diaminodioxyanthraquinone sulfonic acid, bromoethane sulfonic acid, 3-fluoromethanesulfonic acid, perchlorooctane sulfonic acid, aminoethane sulfonic acid, hydroxyheptane sulfonic acid, dodecyloxybutane sulfonic acid, propargyloxypropyl sulfonic acid, acetone disulfonic acid, bis[octylsulfonic acid substituted]-sulfonic acid, dihydroxyethane sulfonic acid, mercaptopropane sulfonic acid, methane sulfonic acid, and $\alpha$-olefine sulfonic acid.

Among the organic phosphoric acid or esters thereof include nitrilotrimethylphosphoric acid, aminodimethylphosphonomonoethylphosphoric acid, ethylenediaminethtramethylphosphoric acid, diethlenetriaminepentamethylphosphoric acid, triethylenetetraminehexamethylphosphoric acid, hydroxyethylidenediphosphoric acid, hydroxypropylidenediphosphoric acid, 1,2,4-tricarboxybutane-2-phosphoric acid, 1,2-dicarboxybutane-2-phosphoric acid,1,2,4-tricarboxyhexane-1-phosphoric acid, $\beta$-chloroethylacidphosphate, bis[(2-hydroxyethyl)-methacrylate]acidphosphate,2-ethylhexylacidphosphate, methylacidphosphate, ethylacidphosphate, propylacedphosphate, butylacidphosphate, octylacidphosphate, decylacidphosphate, laurylacidphosphate, stearylacidphosphate, dibutylacidphosphate, di-($\beta$-chloroethyl-)acidphosphate, di(2-ethylhexyl)acidphosphte, dimethylacidphosphate, diethylacidphosphate, dipropylacidphosphate, dioctylacidphosphate, didecylacidphosphate, dilaurylacidphosphate, distearylacidphosphate, tributylphosphite, tris(2-ethylhexyl)phosphite, tridecylphosphite, tristearylphosphite, tris(nonylphenyl)phosphite, trisphenylphosphite, trislauryltrithiophosphite, tris(2,3-dichloropropyl)phosphite, diphenyldecylphosphite, diphenyltridecylphosphite, trimethylphosphite, triethylphosphite, trioctylphosphite, trilaurylphosphite, dilaurylhydrogenphosphite, diphenylhydrogenphosphite, demethylhydrogenphosphite, diethylhydrogenphosphite, depropylhydrogenphosphite, dibutylhydrogenphosphite, dioctylhydrogenphosphite, didecylhydrogenphosphite, distearylhydrogenphosphite. These acid catalysts only named few, not limiting thereto.

The amount of acid catalyst to be used in the sizing agent is 0.0001 to 10.0 parts by weight, preferably 0.001 to 1 parts by weight of the acid catalyst per 100 parts by weight of the sizing agent.

The following Examples will illustrate the present invention, but but are not intended to be unduly limiting

COMPARATIVE EXAMPLE 1

A sizing agent was prepared by mixing 10 g of cationic starch with 90ml water, boiling the resulting mixture at 95°-97° C. for 15 minutes and then adding 5 g of dodecylsuccinic anhydride thereto.

COMPARATIVE EXAMPLE 2

A sizing agent was prepared similar to Comparative Example 1 except that octadecenylsuccinic anhydride acid was used in place of dodecylsuccinic anhydride.

COMPARATIVE EXAMPLE 3

A sizing agent was prepared by modifying the pH of a commercially available rosin based sizing agent to 4.5 with alum.

COMPARATIVE EXAMPLE 4

A sizing agent was prepared by adding cationized cellulose to a commercially available alkylketene dimer based sizing agent in an amount of 25 % by weight of the agent.

EXAMPLE 1

In a 4-necked flask 1 mole of dodecenylsuccinic anhydride and 1 mole of allylalcohol were reacted together at 110°±5 ° C. for 2 hours to form a monoallyl ester of dodecylsuccinic acid. The product thus obtained was then converted to its triethanolamine salt whihc is a viscous yellowish brown liquid having a good self-emulsifiability in water.

Similarly, monoesters hereinafter described were prepared and these monoesters were subjected to a sizing test in the form of amine salts, sodium salts or potassium salts and like.

The degree of sizing the above mentioned sizing agents was measured under conditions set forth below. The test results thus obtained are reproduced in Table 1 (succinic acid is abbreviated as s.a.). Each sizing agent was added to a 0.5% aqueous pulp slurry in an amounts of 0.05, 0.1 and 0.2% by weight of the sizing agent (solid base) and then mixed together for 15 minutes.

The test conditions were as follows:

| | |
|---|---|
| pulp concentration | 0.5% |
| paper-making procedure | TAPPI STANDARD MACHINE |
| basis weight | 70 g/m$^2$ |
| filler | heavy calcium carbonate |
| drying | 110° C. for 5 minutes |
| sizing test | JIS P8122 Stochtigt sizing test |

TABLE 1

| Sample No. | sizing agent | wt. % added 0.05 | 0.1 | 0.2 |
|---|---|---|---|---|
| 1 | Na salt monoallylester of hexenyl-s.a. | 12 | 23 | 30 |
| 2 | K salt of monopropargyl ester of octenyl-s.a. | 11 | 22 | 29 |
| 3 | TEA salt of monooleyl ester of decenyl-s.a. | 11 | 21 | 29 |
| 4 | TEA salt of monoallyl ester of dodecenyl-s.a. | 12 | 23 | 31 |
| 5 | MEA salt of monobutenyl ester of octadecenyl-s.a. | 11 | 20 | 29 |
| 6 | TEtA salt of monohexenyl ester of dodecenyl-s.a. | 13 | 23 | 30 |
| 7 | MMtA salt of monolaurenyl ester of octenyl-s.a. | 12 | 22 | 28 |
| 8 | TEA salt of monobutinyl ester of octadecenyl-s.a. | 11 | 21 | 27 |
| 9 | DEA salt of monopropargyl ester of dodecenyl-s.a. | 13 | 22 | 29 |
| 10 | MEA salt of monoallyl ester of octadecenyl-s.a. | 13 | 23 | 30 |
| 11 | MEA salt of monoallyl ester of eicocenyl-s.a. | 11 | 20 | 27 |
| 12 | DEA salt of monopropargyl ester tetracocenyl-s.a. | 11 | 21 | 27 |
| 13 | MEA salt of monobutenyl ester of triancotenyl-s.a. | 12 | 21 | 28 |
| 14 | TEA salt of monopentenyl ester of tetracocenyl-s.a. | 12 | 20 | 27 |
| 15 | TEtA salt of monooleyl ester of eicocenyl-s.a. | 12 | 2O | 28 |
| Comparative Examples | | | | |
| 1 | dodecenylsuccinic anhydride | 3 | 9 | 14 |
| 2 | octadecenylsuccinic anhydride | 4 | 10 | 16 |
| 3 | rosin based sizing agent | 9 | 12 | 20 |
| 4 | alkylketene dimer based sizing agent | 11 | 20 | 26 |

Note:
TEA: triethanolamine;
DEA: diethanolamine;
MEA: monoethanolamine
TEtA: triethylamine;
MMtA: monomethylamine;

From the foregoing, it is clear that the sizing agents of the present invention have superior sizing effects over the conventional ones.

EXAMPLE 2

Cationic starch (10 g) was boiled with 90 ml of water at 95°-97 ° C. for 15 minutes to which was added 5 g of the sizing agent set forth in Table 2 and resultant product was subjected to the sizing test as set forth in Example 1 in order to measure the degree of sizing achieved by the product. The results obtained are reproduced in Table 2 below.

TABLE 2

| Sample No. | Sizing agent | wt. % added 0.05 | 0.1 | 0.2 |
|---|---|---|---|---|
| 16 | monoallyl ester of dodecenyl-s.a. | 12 | 24 | 35 |
| 17 | monopropargyl ester of octadecenyl-s.a. | 12 | 22 | 32 |
| 18 | monoallyl ester of eicocenyl-s.a. | 12 | 21 | 30 |
| 19 | monolaurenyl ester of octenyl-s.a. | 12 | 23 | 31 |
| 20 | monooleyl ester of triancotenyl-s.a. | 12 | 22 | 30 |
| 21 | TEA salt of monoallyl ester of dodecenyl-s.a. | 13 | 24 | 33 |
| 22 | TEA salt of monopropargyl ester of octenyl-s.a. | 13 | 22 | 30 |
| 23 | DEA salt of monopropargyl ester of dodecenyl-s.a. | 14 | 23 | 32 |
| 24 | MEA salt of monobutenyl ester of octadecenyl-s.s. | 13 | 22 | 31 |
| Comparative Examples | | | | |
| 1 | dodecenylsuccinic anhydride | 3 | 9 | 14 |
| 2 | octadecenylsuccinic anhydride | 4 | 10 | 16 |

COMPARATIVE EXAMPLE 5

A monoallylester of docenylsuccinic acid was prepared as in Example 3 hereinafter described and the resultant product was modified with cationic starch to form a homogenous slurry.

COMPARATIVE EXAMPLE 6

A monoallylester of octadecenylsuccinic acid was prepared as in Example 3 hereinafter described, but without addition of benzene sulfonic acid. The resultant monoallylester was mixed with cationic starch as in Comparative Example 1 to form a homogeneous slurry.

EXAMPLE 3

A monoallylester of octadecenylsuccinic acid was synthesized by reacting in a three-necked flask 1 mole of octadecenylsuccinic anhydride and 1 mole of allylalcohol together at 110°±5 ° C. for two hours. To the resultant monoallylester of octadecenylsuccinic acid was added 0.1% by weight of benzenesulfonic acid on the basis of the weight of the monoallylester. The product thus obtained was modified with cationic starch as in Comparative Example 1 to form a homogeneous slurry (sample No.25).

Similarly additional sizing agents were prepared as set forth in Table 3.

Each sizing agent produced in Example 3 and Comparative Examples 1 to 4 set forth above and Comparative Examples 5 and 6 were added to a 0.5% pulp slurry so as to provide sizing agent concentration of 0.05%, 0.1%, and 0.2% on the basis of the pulp solid and then mixed together for 15 minutes. The resulting slurry was subjected to a sizing test. The results obtained are reproduced in Tables 3 and 4.

Sizing test conditions:

| | |
|---|---|
| Pulp: | LBKP:NBKP = 1:1 |
| CSF: | 400 |
| paper-making | TAPPI STANDARD MACHINE |
| basis weight | 70 g/m$^2$ |
| filler | heavy calcium carbonate |
| drying | 110° C. for 5 minutes |
| sizing degree | JIS P-8122 Stochigt sizing test procedure |

TABLE 3

| Sample No. | sizing agent | cat. wt. % | Wt. % added 0.05 | 0.1 | 0.15 |
|---|---|---|---|---|---|
| 25 | monoallylester of octadecenyl-s.a. | benzenesulfonic acid 0.1 | | | |
| 26 | monoallylester of hexenyl-s.a. | benzenesulfonic acid 0.1 | 16 | 48 | 59 |
| 27 | monopropargylester of octenyl-s.a. | napthylsulfonic acid 0.1 | 15 | 42 | 51 |
| 28 | monoalyllester of decenyl-s.a. | toluenesulfonic acid 0.2 | 17 | 54 | 63 |
| 29 | monoallylester of dodecenyl-s.a. | toluenesulfonic acid 0.1 | 19 | 61 | 72 |
| 30 | monoohexenylester of octadecenyl-s.a. | butylbenzenesulfonic acid 0.15 | 17 | 58 | 66 |
| 31 | monobutenylester of dodecenyl-s.a. | methylnaphthylsulfonic acid 0.1 | 16 | 56 | 65 |
| 32 | monoallylester of octadecenyl-s.a. | ligninsulfonic acid 0.1 | 21 | 66 | 75 |
| 33 | monopentenylester of octenyl-s.a. | phosphoric acid 0.1 | 14 | 41 | 50 |
| 34 | monodecenylester of dodecenyl-s.a. | zinc chloride 0.15 | 14 | 42 | 53 |
| 35 | monooleylester of dococenyl-s.a. | ferric chloride 0.15 | 15 | 46 | 55 |
| 36 | monobutenylester of triancotenyl-s.a. | benzenesulfonic acid 0.15 | 16 | 51 | 60 |
| 37 | monobutynester of eicocenyl-s.a. | diethylbenzenesulfonic acid 0.05 | 13 | 39 | 48 |
| 38 | monolaurenylester of octadecenyl-s.a. | toluenesulfonic acid 0.2 | 13 | 60 | 71 |
| 39 | monooctenylester of eicocenyl-s.a. | aluminium chloride 0.3 | 17 | 56 | 63 |
| 40 | monopropargylester of hexenyl-s.a. | propylnaphthysulfonic acid 0.05 | 14 | 40 | 50 |
| 41 | monobutynester of dodecenyl-s.a. | sulfuric acid | | | |

TABLE 3-continued

| Sample No. | sizing agent | cat. wt. % | Wt. % added 0.05 | 0.1 | 0.15 |
|---|---|---|---|---|---|
| | | 0.5 | 13 | 36 | 43 |
| 42 | monoallylester of octenyl-s.a. | toluenesulfonic acid 0.15 | 20 | 63 | 72 |
| 43 | monopropargylester of triancotenyl-s.a. | ligninsulfonic acid 0.1 | 13 | 40 | 50 |
| 44 | monoallylester of octadecenyl-s.a. | phosphoric acid 0.1 | 16 | 54 | 64 |
| Comparative Examples | | | | | |
| 1 | dodecenylsuccinic anhydride | phosphoric acid 0.1 | 6 | 15 | 21 |
| 2 | octadecenyl succinic anhydride | phosphoric acid 0.1 | 7 | 18 | 26 |
| 3 | rosin based sizing agent | — | 10 | 14 | 20 |
| 4 | alkylketene dimer based sizing agent | — | 11 | 20 | 27 |
| 5 | monoallylester of dodecenyl-s.a. | — | 13 | 24 | 35 |
| 6 | monoallylester of octadecenyl-s.a. | — | 16 | 22 | 34 |

TABLE 4

| Sample No. | sizing agent | Cat. wt. % | wt. % added 0.05 | 0.1 | 0.2 |
|---|---|---|---|---|---|
| 45 | monopropargylester of hexenyl-s.a. | bromoethanesulfonic acid 0.1 | 12 | 32 | 44 |
| 46 | monobutenylester of octenyl-s.a. | perchlorooctanesulfonic acid 0.1 | 12 | 31 | 44 |
| 47 | monoallylester of decenyl-s.a. | aminoethanesulfonic acid 0.15 | 11 | 29 | 40 |
| 48 | monooleylester of dodecenyl-s.a. | hydroxyheptanesulfonic acid 0.15 | 11 | 30 | 42 |
| 49 | monopentenylester of octadecenyl-s.a. | dodecyloxypropylsulfonic acid 0.2 | 12 | 34 | 46 |
| 50 | monoallylester of eicocenyl-s.a. | acetonedisulfonic acid 0.05 | 11 | 31 | 43 |
| 51 | monohexenylester of triacontenyl-s.a. | dioctylsulfonic acid-substituted-s.a. 0.15 | 12 | 33 | 46 |
| 52 | monopropargylester of dodecenyl-s.a. | mercaptpropanesulfonic acid 0.2 | 12 | 33 | 45 |
| 53 | monoallylester of octadecenyl-s.a. | methanesulfonic acid 0.1 | 11 | 30 | 41 |
| 54 | monoallylester of octenyl-s.a. | dichlorobezenesulfonic acid 0.15 | 13 | 36 | 48 |
| 55 | mnopropargylester of decenyl-s.a. | dichlorotoluenesulfonic acid 0.15 | 13 | 35 | 44 |
| 56 | monooleylester of hexenyl-s.a. | aminotoluenesulfonic acid 0.5 | 14 | 40 | 50 |
| 57 | monolaurenylester of dodecenyl-s.a. | nitrobenzensulfonic acid 0.1 | 16 | 43 | 58 |
| 58 | monobutenylester of octadecenyl-s.a. | dintromethylenesulfonic acid 0.1 | 15 | 43 | 57 |
| 59 | monobutenylester of dococenyl-s.a. | nitrorchlorobenzenesulfonic acid 0.15 | 13 | 37 | 45 |
| 60 | monohexenylester of decenyl-s.a. | dinitrochlorobenzenesulfonic acid 0.15 | 15 | 41 | 51 |
| 61 | monoallylester of triacontenyl-s.a. | phenolsulfonic acid 0.2 | 18 | 55 | 65 |
| 62 | monopropargylester of octenyl-s.a. | cresolsulfonic acid 0.2 | 14 | 37 | 50 |
| 63 | monoallylester of dodecenyl-s.a. | naphthalenedisulfonic acid 0.05 | 20 | 60 | 78 |
| 64 | monopentenylester of eicocenyl-s.a. | naphthalenetrisulfonic acid 0.05 | 19 | 58 | 77 |
| 65 | monooleylester of octadecenyl-s.a. | nitronaphthalenedisulfonic acid 0.05 | 17 | 56 | 76 |
| 66 | monoallylester of octadecenyl-s.a. | naphtolsulfonic acid 0.1 | 21 | 61 | 79 |
| 67 | monoallylester of dodecenyl-s.a. | aminonaphtholsulfonic acid 0.1 | 18 | 59 | 78 |
| 68 | monohexenylester of dococenyl-s.a. | anthracenesulfonic acid 0.15 | 17 | 55 | 75 |
| 69 | monooctenylester of hexenyl-s.a. | anthraquinonesulfonic acid 0.15 | 17 | 54 | 72 |
| 70 | monooleylester of octenyl-s.a. | anthraquinonedisulfonic acid 0.1 | 19 | 59 | 79 |
| 71 | monobutenylester of eicocenyl-s.a. | aminoanthraquinonesulfonic acid 0.15 | 14 | 38 | 52 |
| 72 | monopropargylester of triancontenyl-s.a. | nitroantraquinonesulfonic acid 0.1 | 15 | 39 | 55 |

TABLE 4-continued

| Sample No. | sizing agent | Cat. wt. % | wt. % added 0.05 | 0.1 | 0.2 |
|---|---|---|---|---|---|
| 73 | monoallylester of dodecenyl-s.a. | hydroxyethilidenediphosphoric acid 0.2 | 22 | 65 | 76 |
| 74 | monoallylester of octadecenyl-s.a. | 1,2,4-tricaboxybutane-2-phosphoric acid 0.1 | 20 | 63 | 75 |
| 75 | monopropargylester of octenyl-s.a. | 1,2-dicarboxybutane-2-phosphoric acid 0.2 | 19 | 60 | 72 |
| 76 | monooleylester of decenyl-s.a. | nitorilotrimethylphosphoric acid 0.1 | 16 | 59 | 72 |
| 77 | monobutenylester of hexenyl-s.a. | hydroxypropylidendiphosphoric acid 0.2 | 21 | 63 | 74 |
| 78 | monoallylester of triancotenyl-s.a. | triethylenetetraminehexamethyl-phosphoric acid 0.2 | 17 | 58 | 70 |
| 79 | monopropargylester of octadecenyl-s.a. | phosphorous acid 0.15 | 12 | 55 | 65 |
| 80 | monopropargylester of dodecenyl-s.a. | hypophosphorous acid 0.15 | 14 | 53 | 64 |
| 81 | monoallylester of dodecenyl-s.a. | 2-ethylhexylacidphosphate 0.1 | 22 | 66 | 77 |
| 82 | monoallylester of octadecenyl-s.a. | buthylacidphosphate 0.1 | 23 | 67 | 79 |
| 83 | monopropargylester of decenyl-s.a. | β-chloroethylacidphospate 0.15 | 21 | 64 | 74 |
| 84 | monooleylester of hexenyl-s.a. | bis[(2-hydroxyethyl)methacrylate]-acidphosphate 0.15 | 20 | 63 | 72 |
| 85 | monopropargylester of dodecenyl-s.a. | laurylacidphosphate 0.15 | 21 | 65 | 74 |
| 86 | monoallylester of octadecenyl-s.a. | dibuthylacidphosphate 0.1 | 24 | 65 | 78 |
| 87 | monooleylester of hexenyl-s.a. | distearylacidphospate 0.15 | 22 | 64 | 73 |
| 88 | monoallylester of dodececyl-s.a. | di(2-ethyhexyl)acidphosphate 0.15 | 21 | 67 | 78 |
| 89 | monopropargylester of decenyl-s.a. | di(β-chloroethyl)acidphosphate 0.2 | 21 | 65 | 75 |
| 90 | monobuthenylester of dodecenyl-s.a. | diocthylacidphosphate 0.1 | 22 | 63 | 74 |
| 91 | monohexenylester of triancotenyl-s.a. | tributhylphosphite 0.2 | 17 | 52 | 70 |
| 92 | monopenthenylester of octenyl-s.a. | tristearylphosphate 0.2 | 15 | 41 | 68 |
| 93 | monooleylester of eicocenyl-s.a. | tris(2,3-dichloropropyl)phosphite 0.15 | 14 | 40 | 66 |
| 94 | monobuthenylester of octadecenyl-s.a. | diphenyldecylphosphite 0.15 | 16 | 51 | 71 |
| 95 | monopropargylester of dodecenyl-s.a. | diphenylhydrogenphosphite 0.2 | 13 | 39 | 62 |

What is claimed is:

1. A method of sizing paper utilizing a composition comprising one or more partial esters of alkenyl succinic acids represented by the formula:

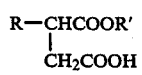

and/or one or more salts thereof, wherein R represents an unsaturated hydrocarbyl group havign at least 6 carbon atoms and R' represents an unsaturated hydrocarbyl group having 3 to 18 carbon atoms.

2. The method of claim 1 including the composition contained therein wherein said salt is selected from a water soluble amine salt and/or an alkaline metal salt.

3. The method of claim 1 including the composition therein wherein an acid catalyst is further included therein.

4. The method of claim 3 wherein said composition includes a catalyst selected from the group consisting of sulfonic acid, and organic phosphoric acid, an inorganic acid, or a Lewis acid.

5. The method of claim 4, including the composition therein wherein said inorganic acid is selected from the group consisting of phosphoric acid, phosphorous acid, hypophosphorous acid, sulfuric acid, hydrochloric acid, or nitric acid.

6. The method fo claim 4, including the composition therein wherein said Lewis acid is selected from boron-fluoride, zinc chloride, aluminum chloride, or ferric chloride.

* * * * *